US009630116B1

(12) United States Patent
Chin

(10) Patent No.: US 9,630,116 B1
(45) Date of Patent: Apr. 25, 2017

(54) SLIDE FIXED BY FLEXIBLE UNIT

(71) Applicant: T.K. CHIN COMPANY LTD., Taipei (TW)

(72) Inventor: Howard Chin, Taipei (TW)

(73) Assignee: T. K. Chin Company, Ltd., Taipei (TW)

( * ) Notice: Subject to any disclaimer, the term of this patent is extended or adjusted under 35 U.S.C. 154(b) by 0 days.

(21) Appl. No.: 15/198,077

(22) Filed: Jun. 30, 2016

(30) Foreign Application Priority Data

Jun. 1, 2016 (TW) ..... 105117289 A

(51) Int. Cl.
*A63G 21/04* (2006.01)
*A63G 21/00* (2006.01)
*A63B 9/00* (2006.01)

(52) U.S. Cl.
CPC ..... *A63G 21/00* (2013.01)

(58) Field of Classification Search
CPC ..... A63G 21/00; A63G 21/04; A63G 21/16; A63B 1/00; A63B 1/005; A63B 9/00
USPC ..... 472/116–117; 104/69–70
See application file for complete search history.

(56) References Cited

U.S. PATENT DOCUMENTS

| | | | | |
|---|---|---|---|---|
| 2,270,909 A * | 1/1942 | Spizer | A63G 21/02 | 182/49 |
| 2,839,299 A * | 6/1958 | Weiss | A63B 1/005 | 297/118 |
| 8,458,864 B1 * | 6/2013 | Patton | A61F 5/3792 | 24/16 R |
| 8,771,093 B2 * | 7/2014 | Bowen | A63G 21/02 | 472/116 |
| 9,308,460 B1 * | 4/2016 | Chin | A63G 21/04 | |

* cited by examiner

*Primary Examiner* — Kien Nguyen
(74) *Attorney, Agent, or Firm* — Rosenberg, Klein & Lee

(57) ABSTRACT

A slide has a slide body and a fixing assembly. The fixing assembly has a connecting rod mounted on the slide body, a flexible unit, and a fixing unit. An end of the flexible unit is connected to the connecting rod. The fixing unit is mounted on the flexible unit. The fixing unit and the flexible unit jointly fix a tread of an open riser stairway. As the flexible unit is bendable, the flexible unit and the fixing unit can be easily moved to clamp the tread, thereby facilitating easy assembly and disassembly.

12 Claims, 6 Drawing Sheets

SLIDE FIXED BY FLEXIBLE UNIT

CROSS-REFERENCE TO RELATED APPLICATIONS

This application is based upon and claims priority under 35 U.S.C. 119 from Taiwan Patent Application No. 105117289 filed on Jun. 1, 2016, which is hereby specifically incorporated herein by this reference thereto.

BACKGROUND OF THE INVENTION

1. Field of the Invention

The present invention relates to a slide for mounting on a stairway, especially to a slide for mounting on an open riser stairway by a flexible unit.

2. Description of the Prior Arts

Slides generally include the following two types: the type designed for standing on the ground alone and the type designed for mounting on a stairway. The latter is often for an open riser stairway, and may comprise a slide body and a fixing assembly. The slide body comprises a platform section and a slide section. The platform section is put on one of the multiple treads of the open riser stairway. The fixing assembly is mounted securely on a bottom surface of the platform section, and clamps the tread front and rear to securely mount the slide body on said tread.

However, the fixing assembly often comprises rigid components, such as two clamping units and a threaded rod. Two ends of the threaded rod are respectively and pivotally connected to the two clamping units, such that a user can rotate the threaded rod to adjust the distance between the two clamping units to clamp the tread. But, it takes time to assemble and disassemble the fixing assembly, which is composed of rigid components, onto and from the tread. For example, rotating the threaded rod to adjust the distance and abutting force takes much time. As a result, the conventional slide needs to be improved. To overcome the shortcomings, the present invention provides a slide fixed to a stairway by a flexible unit to mitigate or obviate the aforementioned problems.

SUMMARY OF THE INVENTION

The main objective of the present invention is to provide a slide that clamps the tread by a flexible unit, thereby facilitating easy assembly and disassembly.

The slide is for an open riser stairway, which comprises multiple treads, and the slide comprises:

- a slide body having
- a platform section; and
- a slide section connected to the platform section, the slide section extending and inclined downward; and
- a fixing assembly mounted on the platform section, and having
  - a connecting rod mounted securely on a bottom of the platform section, and extending horizontally;
  - a flexible unit, and an end of the flexible unit connected to the connecting rod; and
  - a fixing unit mounted on the flexible unit, and the fixing unit and the flexible unit jointly fixing one of the treads.

When the slide is in use, as the flexible unit is bendable, the flexible unit and the fixing unit can easily and securely clamp the tread. Compared with the conventional slide with rigid components, the flexible unit and the fixing unit of the present invention can be easily moved to clamp the tread, thereby facilitating easy assembly and disassembly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
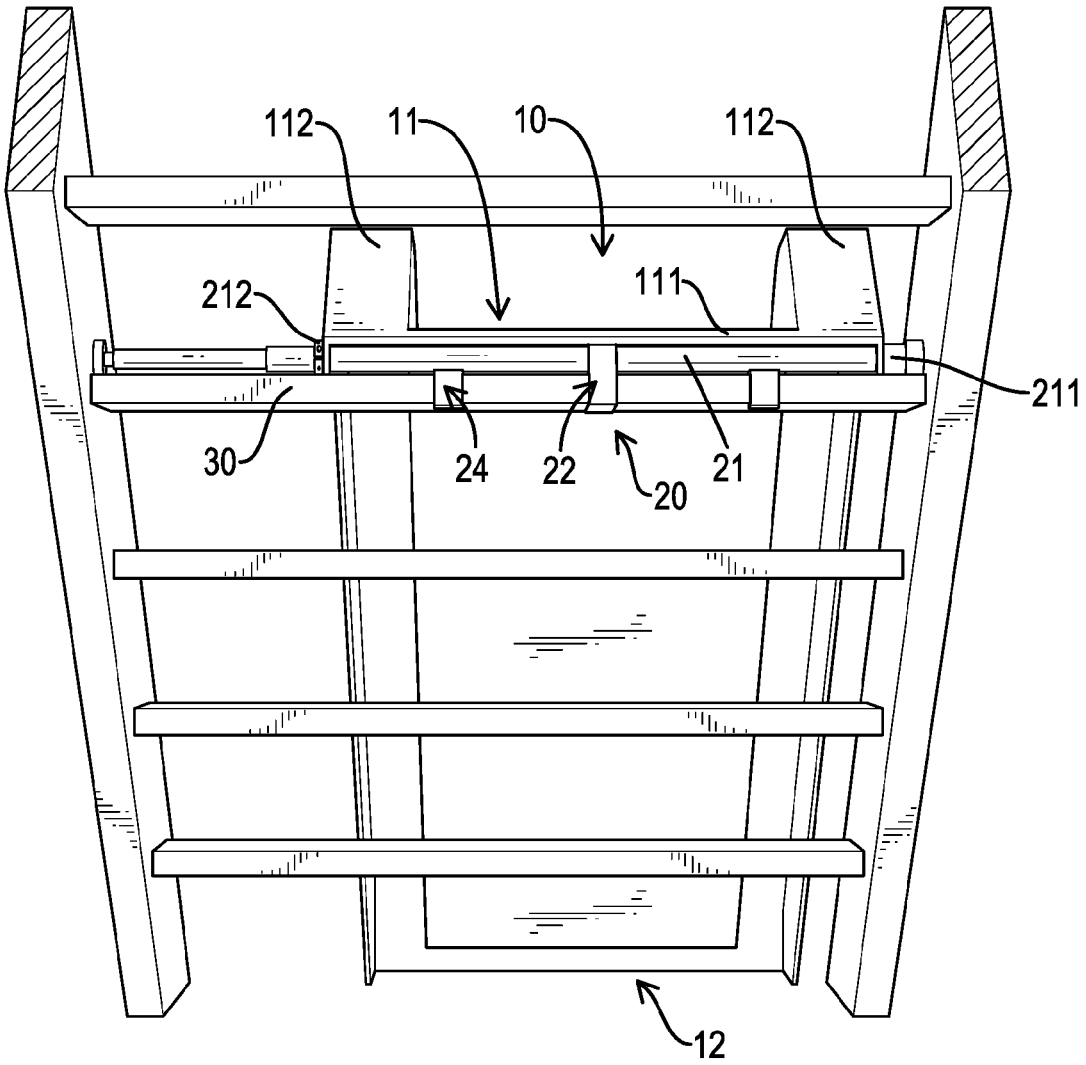
FIG. 1 is a rear view of a first embodiment of a slide fixed by a flexible unit in accordance with the present invention, shown mounted on a stairway.

With reference to FIG. 1, a slide in accordance with the present invention is used for an open riser stairway and fixed to the stairway by a flexible unit, and the open riser stairway comprises multiple treads. A first embodiment of the slide comprises a slide body 10 and a fixing assembly 20.

Figure 2:
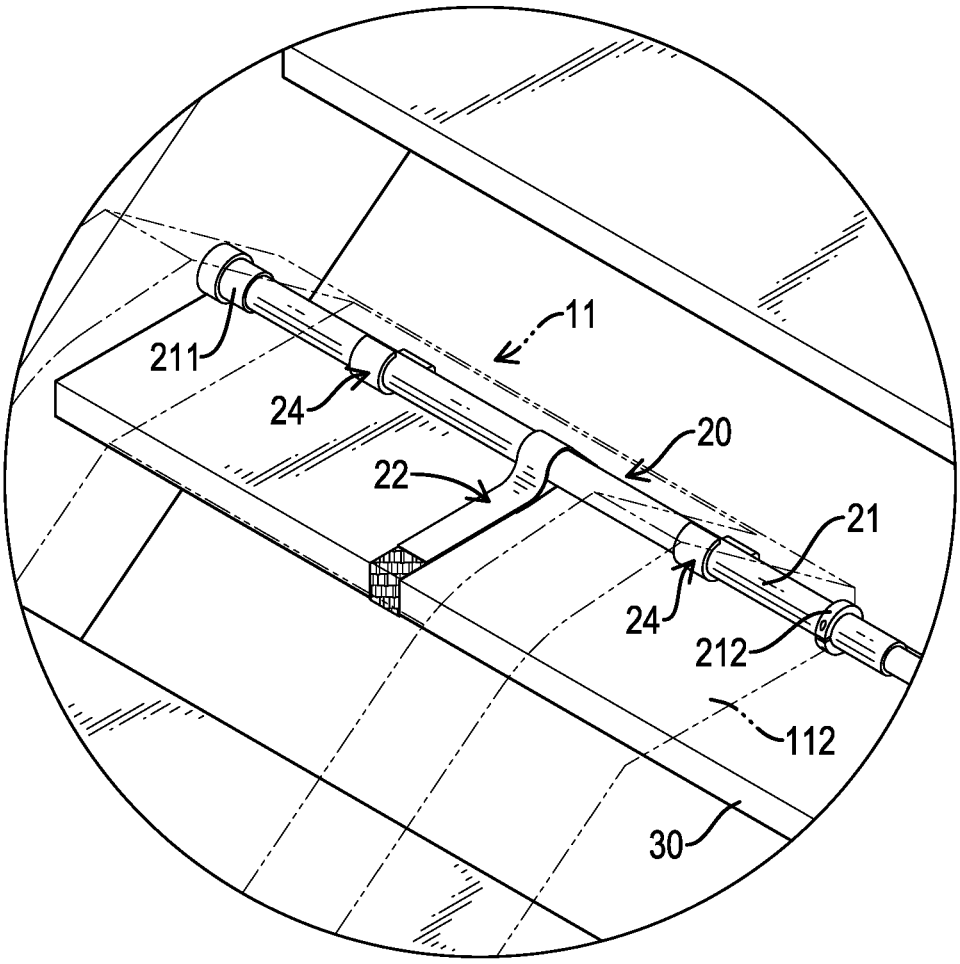
FIG. 2 is a perspective view of a fixing assembly of the slide in FIG. 1, shown mounted on the stairway.
Figure 3:
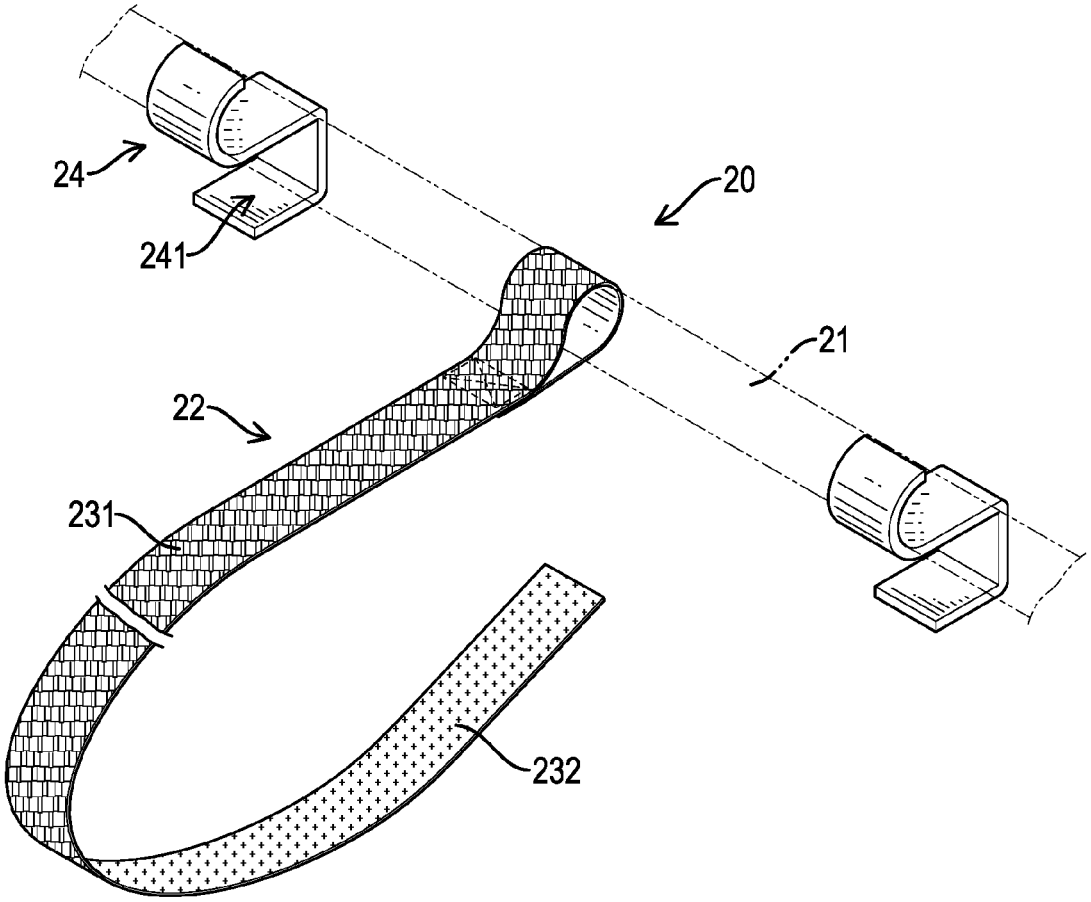
FIG. 3 is a perspective view of a fixing assembly of the slide in FIG. 1.
Figure 4:
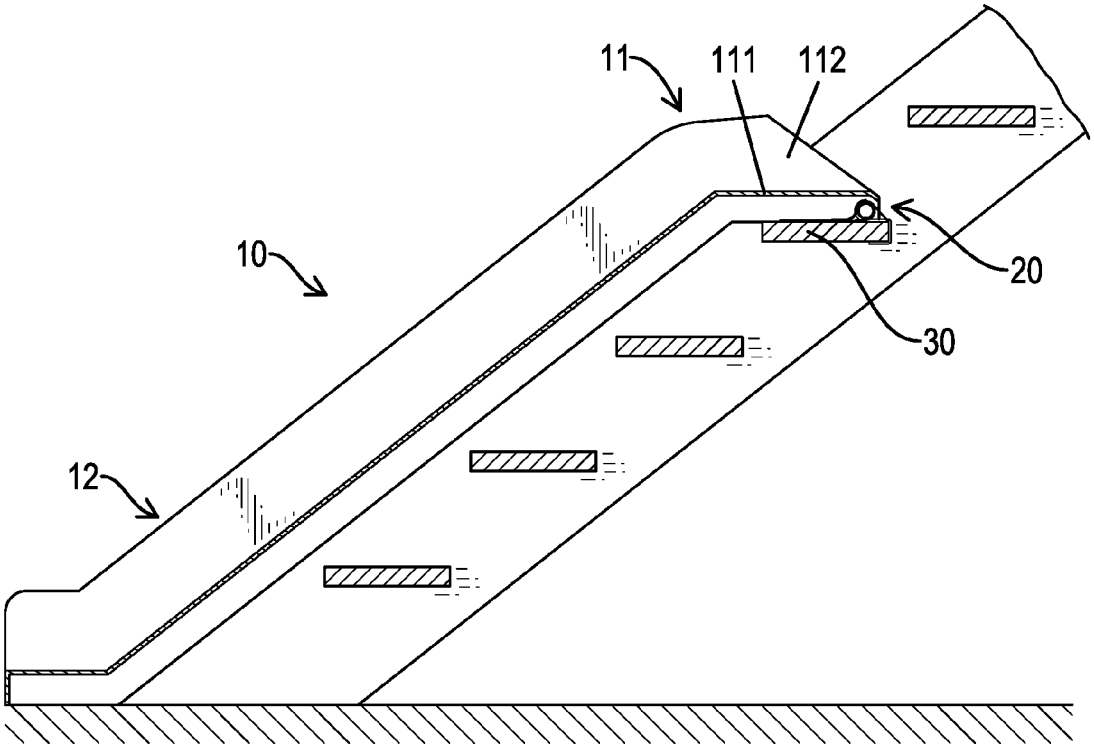
FIG. 4 is a side view in partial section of the slide in FIG. 1, shown mounted on the stairway.
Figure 5:
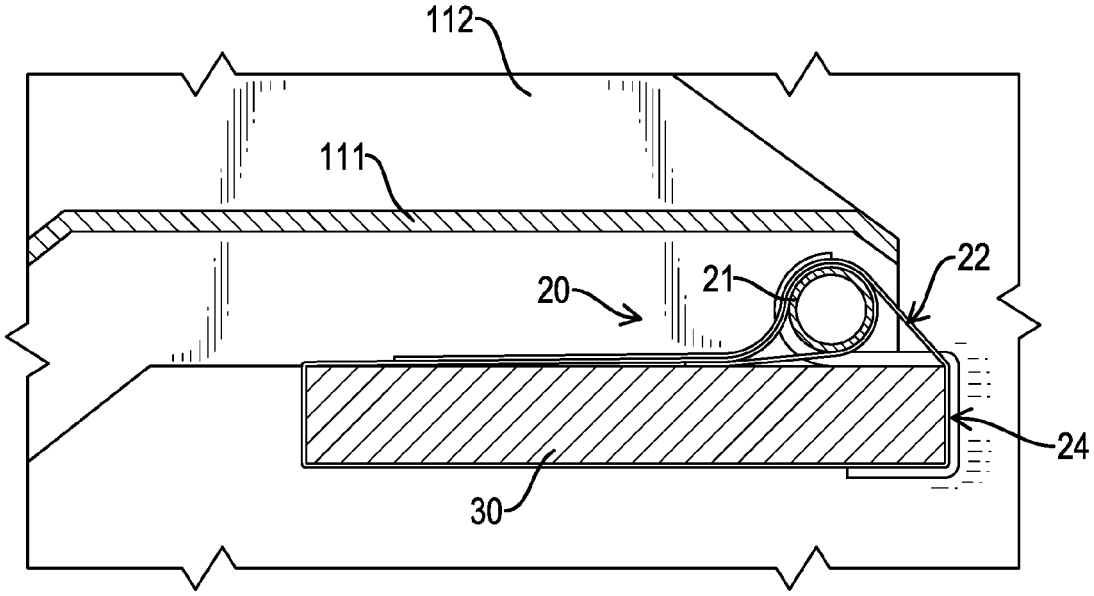
FIG. 5 is an enlarged side view in partial section of the slide in FIG. 1, shown mounted on the stairway.

With reference to FIGS. 1, 2, and 4, the slide body 10 has a platform section 11 and a slide section 12. The platform section 11 has a platform 111 and two side walls 112. The two side walls 112 are vertically and securely mounted on two transverse sides of the platform 111 and extend downward. The slide section 12 is connected to the platform section 11, and extends and is inclined downward from a front side of the platform section 11. In a preferred embodiment, the slide section 12 is preferably, but not limited to, formed integrally. The slide section 12 also may comprise multiple separate parts for a user to assemble depending on the desired length.

With reference to FIGS. 1 and 3 to 5, the fixing assembly 20 is mounted on the platform section 11 of the slide body 10, and has a connecting rod 21, a flexible unit 22, a fixing unit, and two hooks 24. The connecting rod 21 is mounted securely on a bottom of the platform section 11, and extends horizontally. In a preferred embodiment, two ends of the connecting rod 21 are respectively mounted through the two side walls 112 of the platform section 11. The connecting rod 21 has an abutting sleeve 211 and a positioning unit 212. The abutting sleeve 211 is mounted securely on one of the two ends of the connecting rod 21. The positioning unit 212 is securely mounted around the connecting rod 21. The positioning unit 212 and the abutting sleeve 211 clamp the two side walls 112 of the platform section 11 to hold the slide body 10 on a position on the axis the connecting rod 21. The positioning unit 212 can be held on any position on the axis of the connecting rod 21, such that the fixing assembly 20 can be adapted to slide bodies 10 of different widths. In addition, the connecting rod 21 may be mounted with two positioning units 212 to clamp the two side walls 112, such that the slide body 10 can be held on any position on the axis of the connecting rod 21. In a preferred embodiment, the positioning unit 212 has two half-rings and two screws. The two half-rings are jointly mounted around the connecting rod 21. The two screws are mounted through one of the two half-rings and then screwed with the other half-ring. Therefore, the two half-rings tightly clamp the connecting rod 21. But the structure of the positioning units 212 is by no means limited by the abovementioned, as long as the positioning unit 212 can be held on any position on the axis of the connecting rod 21. In addition, the connecting rod 21 is retractable, such that the connecting rod 21 can be adapted to stairs with different tread widths.

An end of the flexible unit 22 is connected to the connecting rod 21. In a preferred embodiment, the flexible unit 22 is a belt, and the end of the flexible unit 22 surrounds and is fixed on the connecting rod 21. The fixing unit is mounted on the flexible unit 22. The fixing unit and the flexible unit 22 jointly fix one of the treads 30 of the open riser stairway. In a preferred embodiment, the fixing unit has a first adhesive strap 231 and a second adhesive strap 232. The first adhesive strap 231 and the second adhesive strap 232 are respectively attached securely to two opposite surfaces of the flexible unit 22, and the first adhesive strap 231 and the second adhesive strap 232 are detachably adhered to each other.

The two hooks 24 are arranged apart from each other. An end of each hook 24 is mounted securely on the connecting rod 21. In a preferred embodiment, a curved portion of the hook 24 is attached and soldered securely to an outer surface of the connecting rod 21, and the curved portion extends for about 180 degrees. But the connection between the hook 24 and the connecting rod 21 is by no means limited by the abovementioned. The other end of the hook 24 is bent to form a clamping opening 241.

When the slide as mentioned above is in use, the clamping openings 241 of the hooks 24 are disposed around a rear side of the tread 30. Then, the two ends of the connecting rod 21 tightly abut against two sides of the stairway. Finally, the flexible unit 22 surrounds the tread 30 in a loop, and then two ends of the flexible unit 22 are adhered by the first and second adhesive straps 231, 232. The slide thus is easy in assembly and disassembly.

In another preferred embodiment, the slide may be implemented without the hooks 24. The flexible unit 22, which surrounds the tread 30 in a loop and is adhered by the first and second adhesive straps 231, 232, is sufficient to fix the body 10 on the tread 30.

Figure 6:
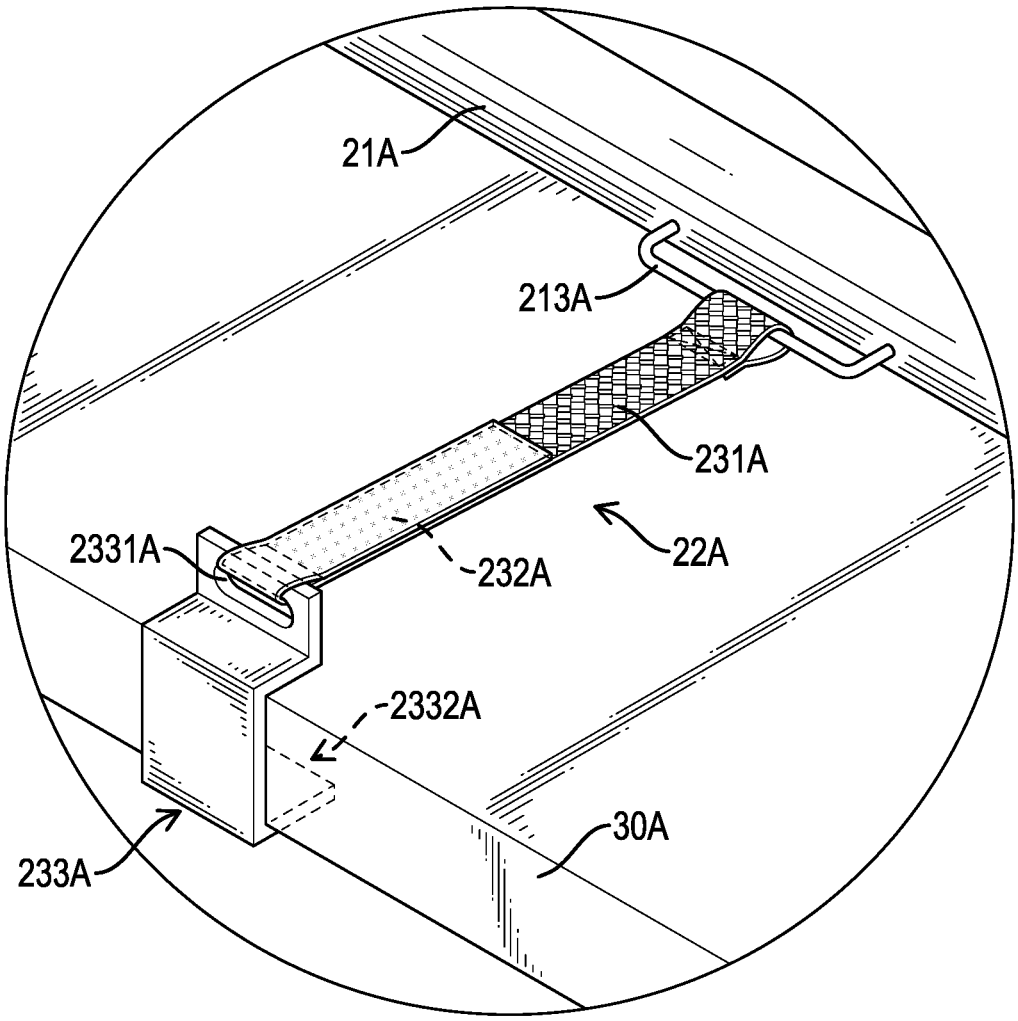
FIG. 6 is a perspective view of the fixing assembly of a second embodiment of a slide fixed by a flexible unit in accordance with the present invention, shown mounted on the stairway.

With reference to FIG. 6, a second embodiment of the slide in accordance with the present invention is substantially similar to the first embodiment mentioned above, but in the second embodiment, the fixing unit further has a hooking unit 233A. The hooking unit 233A has a through hole 2331A formed through an end of the hooking unit 233A. The other end of the hooking unit 233A is bent to form a hooking unit opening 2332A. The first adhesive strap 231A and the second adhesive strap 232A are attached to a same one of the two opposite surfaces of the flexible unit 22A. The flexible unit 22A is mounted and passes through the through hole 2332A, and then is bent and adhered securely back to itself by the first and the second adhesive straps 231A, 232A.

When the second embodiment of the slide is in use, the clamping openings of the two hooks are disposed around the rear side of the tread 30A, and the hooking unit openings 2332A of the hooking unit 233A are disposed around a front side of the tread 30A. Finally, the hooking units 233A are pulled back tightly by the flexible unit 22A and then the flexible unit 22A is adhered to itself by the first and the second adhesive straps 231A, 232A, thereby making the hooks and the hooking units 233A tightly clamp the tread 30A. Thus, the second embodiment of the slide is also easy in assembly and disassembly.

In addition, in the second embodiment, the connecting rod 21A has a mounting rod 213A mounted on the connecting rod 21A. Two ends of the mounting rod 213A are respectively mounted securely on the outer surface of the connecting rod 21A. The end of the flexible unit 22A does not surround the connecting rod 21A, and surrounds the mounting rod 213A instead. But the connection of the end of the flexible unit 22A is by no means limited by the abovementioned.

In addition, in the first and the second embodiments, the flexible unit 22, 22A is a belt. But the flexible unit 22 is by no means limited to a belt. The flexible unit 22, 22A may be any flexible and elongated object, such as a rope or an iron wire. When the rope or the iron wire surrounds the tread, two ends of the rope or two ends of the iron wire are tied into a knot.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A slide adapted for mounting on an open riser stairway, which comprises multiple treads, the slide comprising:

a slide body having a platform section; and a slide section connected to the platform section, the slide section extending and inclined downward; and a fixing assembly mounted on the platform section, and having a connecting rod mounted securely on a bottom of the platform section, and extending horizontally;

a flexible unit having two opposite surfaces, an end of the flexible unit connected to the connecting rod, and being a belt; and a fixing unit mounted on the flexible unit, the fixing unit and the flexible unit jointly fixing the slide body on one of the treads, and the fixing unit having a hooking unit having a through hole formed through the hooking unit, and the flexible unit mounted and passing through the through hole;

a first adhesive strap securely attached to the flexible unit; and a second adhesive strap securely attached to the flexible unit, and detachably adhered to the first adhesive strap;

wherein the first adhesive strap and the second adhesive strap are attached to a same one of the two opposite surfaces of the flexible unit.

2. The slide as claimed in claim 1, wherein the end of the flexible unit surrounds and is fixed on the connecting rod.

3. The slide as claimed in claim 2, wherein the fixing assembly has at least one hook, an end of each one of the at least one hook mounted securely on the connecting rod, and the other end of said hook being bent to form a clamping opening.

4. The slide as claimed in claim 3, wherein the platform section of the slide body has a platform; and two side walls vertically and securely mounted on two transverse sides of the platform and extending downward; and two ends of the connecting rod of the fixing assembly respectively mounted through the two side walls, and the connecting rod being retractable.

5. The slide as claimed in claim 4, wherein the connecting rod has an abutting sleeve mounted securely on one of the two ends of the connecting rod; and a positioning unit securely mounted around the connecting rod, and the positioning unit and the abutting sleeve clamping the two side walls of the platform section.

6. The slide as claimed in claim 1, wherein the connecting rod has a mounting rod mounted on the connecting rod, two ends of the mounting rod respectively mounted securely on an outer surface of the connecting rod, and the end of the flexible unit surrounding the mounting rod.

7. The slide as claimed in claim 6, wherein the fixing assembly has at least one hook, an end of each one of the at least one hook mounted securely on the connecting rod, and the other end of said hook being bent to form a clamping opening.

8. The slide as claimed in claim 7, wherein the platform section of the slide body has a platform; and two side walls vertically and securely mounted on two transverse sides of the platform and extending downward; and two ends of the connecting rod of the fixing assembly respectively mounted through the two side walls, and the connecting rod being retractable.

9. The slide as claimed in claim 8, wherein the connecting rod has an abutting sleeve mounted securely on one of the two ends of the connecting rod; and a positioning unit securely mounted around the connecting rod, and the positioning unit and the abutting sleeve clamping the two side walls of the platform section.

10. The slide as claimed in claim 1, wherein the fixing assembly has at least one hook, an end of each one of the at least one hook mounted securely on the connecting rod, and the other end of said hook being bent to form a clamping opening.

11. The slide as claimed in claim 1, wherein the platform section of the slide body has a platform; and two side walls vertically and securely mounted on two transverse sides of the platform and extending downward; and two ends of the connecting rod of the fixing assembly respectively mounted through the two side walls, and the connecting rod being retractable.

12. The slide as claimed in claim 11, wherein the connecting rod has an abutting sleeve mounted securely on one of the two ends of the connecting rod; and a positioning unit securely mounted around the connecting rod, and the positioning unit and the abutting sleeve clamping the two side walls of the platform section.

* * * * *